US010137477B2

(12) United States Patent
Petersen et al.

(10) Patent No.: US 10,137,477 B2
(45) Date of Patent: Nov. 27, 2018

(54) MODULAR ASSEMBLY FOR MULTIDIMENSIONAL TRANSDUCER ARRAYS

(71) Applicant: Siemens Medical Solutions USA, Inc., Malvern, PA (US)

(72) Inventors: David A. Petersen, Fall City, WA (US); Terry Simpson, Sammamish, WA (US); Walter Petersen, Seattle, WA (US); Jerry Hopple, Seabeck, WA (US); Xuan-ming Lu, Issaquah, WA (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 714 days.

(21) Appl. No.: 14/660,475

(22) Filed: Mar. 17, 2015

(65) Prior Publication Data

US 2016/0271651 A1 Sep. 22, 2016

(51) Int. Cl.

| | |
|---|---|
| ***B06B 1/06*** | (2006.01) |
| ***B06B 1/02*** | (2006.01) |
| *H04R 1/10* | (2006.01) |

(52) U.S. Cl.

CPC ..... *B06B 1/0207* (2013.01); *B06B 1/06* (2013.01); *B06B 2201/20* (2013.01); *H04R 1/1033* (2013.01)

(58) Field of Classification Search

CPC ..... B06B 1/06; B06B 1/0603; B06B 1/0607; B06B 1/0622; B06B 1/0629

USPC ..... 310/322, 334, 335

See application file for complete search history.

(56) References Cited

U.S. PATENT DOCUMENTS

| | | | | |
|---|---|---|---|---|
| 6,879,032 | B2 | 4/2005 | Rosenau et al. | |
| 7,304,415 | B2 | 12/2007 | Petersen et al. | |
| 7,557,489 | B2 | 7/2009 | Petersen et al. | |
| 7,795,784 | B2 | 9/2010 | Davidsen et al. | |
| 8,754,574 | B2 | 6/2014 | Morris et al. | |
| 2005/0225210 | A1 | 10/2005 | Englund et al. | |
| 2006/0035481 | A1* | 2/2006 | Petersen | G01S 7/52079 439/65 |
| 2009/0015101 | A1* | 1/2009 | Petersen | B06B 1/0622 310/327 |

(Continued)

FOREIGN PATENT DOCUMENTS

| | | |
|---|---|---|
| CN | 1577993 | 2/2005 |
| CN | 101102853 | 1/2008 |

OTHER PUBLICATIONS

Office Action dated Dec. 19, 2017 from Korean counterpart application No. 10-2016-0031543, filed Mar. 16, 2016, 17 pages total.

*Primary Examiner* — Derek Rosenau

(57) ABSTRACT

An interconnect is provided for a multidimensional transducer array. An adaptor provides a 90-degrees or other non-zero angle transition of conductors from connection with the elements to connection with a printed circuit board. The adaptor is formed as a component that may surface mount on the printed circuit board and may provide a pitch change from the element pitch to a different pitch, such as a pitch of conductors of an integrated circuit also mounted to the printed circuit board. The adaptor allows stacking of modules where each module uses standardized or regular printed circuit board connections.

14 Claims, 8 Drawing Sheets

(56) References Cited

U.S. PATENT DOCUMENTS

| | | | | |
|---|---|---|---|---|
| 2011/0248603 | A1* | 10/2011 | Tezuka | A61B 8/4405<br>310/314 |
| 2012/0267981 | A1 | 10/2012 | Morris et al. | |
| 2013/0200753 | A1* | 8/2013 | Dausch | B06B 1/0622<br>310/322 |

* cited by examiner

MODULAR ASSEMBLY FOR MULTIDIMENSIONAL TRANSDUCER ARRAYS

BACKGROUND

The present embodiments relate to multidimensional transducer arrays. In particular, a multidimensional transducer array interconnects with electronics used for imaging.

Achieving the interconnection between an acoustic array and the associated transmit and/or receive electronics is a key technological challenge for multidimensional (matrix) transducers. Hundreds or thousands of different elements distributed in two dimensions (azimuth and elevation) require interconnection along the z-axis (depth or range) for at least the elements surrounded by other elements. Since the elements are small (e.g., 250 um), there is limited space for separate electrical connection to each element.

In U.S. Pat. No. 8,754,574, a modular approach is used. For each module, a flex circuit with traces is positioned to connect to some of the elements. To accommodate other modules to connect with other elements, the flex circuit folds over a mechanical substrate or frame. Since the signal traces are confined to one or two surfaces of the flex circuit, the trace density is very high, limiting the size of arrays that can be practically assembled and resulting in electrical crosstalk. The flatness of the laminated assembly of modules must be held to very high tolerance (e.g. +/−2 um corner to corner and along seams). If the surface from laminated modules is out-of-tolerance, correction is not possible and the piece is discarded. The assembly is particularly subject to failures along the lamination lines due to a very tight flex-circuit radius of curvature to allow positioning of other modules. The flex circuit interrupts thermal conduction from the array. There is no straight path for heat to conduct from the array into the frame of the module because all conductors are on the surface of the flex circuit (perpendicular to the desired heat path). Other approaches for multidimensional interconnection suffer from problems of volume, parasitic capacitance, crosstalk, thermal efficiency, manufacturing, and/or electronic packing density.

BRIEF SUMMARY

By way of introduction, the preferred embodiments described below include methods, systems and components for multidimensional transducer array interconnects. An adaptor provides a 90-degrees or other non-zero angle transition of conductors from connection with the elements to connection with a printed circuit board. The adaptor is formed as a component that may surface mount on the printed circuit board and may provide a pitch change from the element pitch to a different pitch, such as a pitch of conductors of an integrated circuit also mounted to the printed circuit board. The adaptor allows stacking of modules where each module uses standardized or regular printed circuit board connections.

In a first aspect, a multidimensional transducer array system is provided. First and second modules each include an adaptor having first and second planar surfaces oriented about 90 degrees relative to each other. The first planar surface connects with the multidimensional transducer array. The modules also include conductors in the adaptor. Separate ones of the conductors electrically connect with separate elements of the multidimensional transducer array. The modules have a printed circuit board with a top surface connected with the second planar surface of the adaptor so that the conductors electrically connect with the printed circuit board. An integrated circuit of each module connects with the printed circuit board such that signals on the conductors are provided at the integrated circuit. The first module stacks with the second module such that the adaptors are in contact with each other and different parts of the multidimensional transducer array.

In a second aspect, an adaptor is provided for interconnection with a matrix transducer array. A first surface has conductors exposed at a first pitch of elements of the matrix transducer array. A second surface has the conductors exposed at a second pitch different than the first pitch along two dimensions. The first surface is about 90 degrees to the second surface.

In a third aspect, a method is provided for routing signals in an ultrasound transducer. Electrodes of elements connect to conductors along a z-axis of an array of the elements. The electrodes and conductors at the electrodes are distributed at a first pitch. The conductors are routed from the elements to a surface spaced from the electrodes. The surface is other than parallel with the array, and the conductors at the surface have a second pitch different than the first pitch along two dimensions.

The present invention is defined by the following claims, and nothing in this section should be taken as a limitation on these claims. Further aspects and advantages of the invention are discussed below in conjunction with the preferred embodiments and may be later claimed independently or in combination. Different embodiments may achieve or fail to achieve different objects or advantages.

BRIEF DESCRIPTION OF THE DRAWINGS

The components and the figures are not necessarily to scale, emphasis instead being placed upon illustrating the principles of the invention. Moreover, in the figures, like reference numerals designate corresponding parts throughout the different views.

DETAILED DESCRIPTION OF THE DRAWINGS AND PRESENTLY PREFERRED EMBODIMENTS

A modular assembly combines a printed circuit board and associated surface-mounted components including an adaptor to make a right-angle connection to the array surface from the printed circuit board. The resulting sub-module is then laminated (stacked and bonded) to form a complete electronic module for attachment to a matrix acoustic array. The modular assembly eliminates an interconnection bottleneck from the printed circuit board, allowing conventional process technology to be employed. After assembly of the modules, the interconnect structure (e.g., cube) provides electrical connection of the array to electronics and outputs signals to other electronics. The electronics in the interconnect formed by the modules generate signals with desired input/output or other terminal properties. The interconnection system is small, allowing use in a hand-held transducer probe. To assemble the probe, standard connectors may be used to route signals to and from the cable.

Testing may be performed for the components, the modules, and the assembled interconnect. Since surface mounting to the printed circuit board is used, the interconnect allows re-use of the surface mounted integrated circuit (e.g., application specific integrated circuit). If the module fails in testing, other modules may still be used as long as not laminated. A small number of known-good components that each have high reliability are integrated for each module.

The adaptor of each module interconnects to the array and may also provide a pitch change in one or two dimensions. The elements of the array are at one pitch and the conductor pads of the integrated circuit are at another pitch. For a pitch change in one dimension by the adaptor, the pitch change in the other dimension is on the printed circuit board. Where the adaptor achieves a pitch change in both dimensions, the printed circuit board may not have to implement the pitch change.

The laminated stack of modules (i.e., the interconnect) may include thermal fins between sub-modules for heat removal. The printed circuit board may include thermal features built into the board for the same purpose.

Figure 1A:
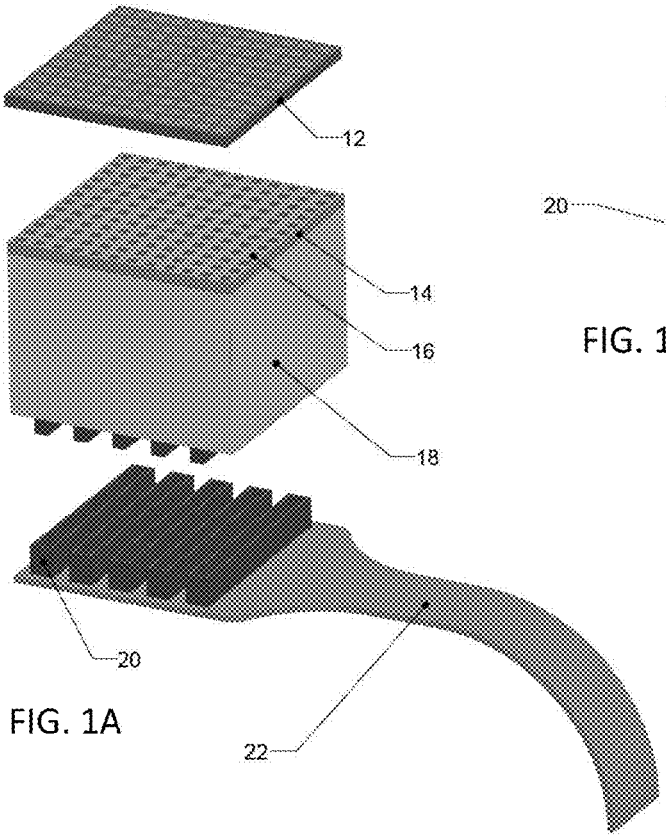
FIG. 1A is an exploded view of an embodiment of an interconnect system for a transducer array.
Figure 1B:
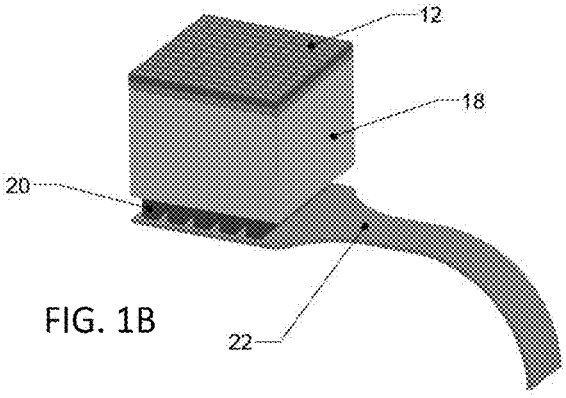
FIG. 1B is an assembled view of the interconnect system.

FIGS. 1A and 1B show one embodiment of a multidimensional transducer array system. The system includes a multidimensional transducer array 12 of elements, an acoustic backing 14, conductors 16 for connecting with the electrodes on the elements of the array 12, the interconnect 18, connectors 20 for connecting with the interconnect 18, and a flexible circuit 22 for connecting the interconnect 18 with the imaging system or probe cable.

Additional, different, or fewer components may be provided. For example, the acoustic backing 14 is not provided or is incorporated within the interconnect 18. As another example, a cable with wires is used instead of a flexible circuit 22 and/or the connectors 20. In yet another embodiment, the flexible circuit 22 connects by bonding, anisotropic conductive film, or other mechanism to the interconnect 18 without the standardized connectors 20. In yet another embodiment, flexible circuit "tails" emerge from each otherwise rigid printed circuit board module to make contact to a cable or common interconnection board via connectors, ACF, bonding, or other mechanism.

The interconnect system as assembled is compact, such as being entirely within the shadow of the array 12. The interconnect 18 does not extend in azimuth or elevation beyond the array. To provide a common return or ground from the other side of the element array 12 one or more additional connections are provided. Although the signal connections reside within the shadow of the elements, the common return connection may be outside that shadow. A small number of additional wires may be placed in the adaptor with relaxed dimensional tolerances. In alternative embodiments, thermal fins, printed circuit board, or other parts of the interconnect 18 extend beyond the array 12 in azimuth and/or elevation. In range, sufficient extent for an adaptor 32 (see FIG. 2) and a printed circuit board 34 (see FIG. 2) with the desired electronics and connectors is provided. Relatively short conductors 16 extend from the array 12 to the printed circuit board 34. The interconnect 18 assembled with the array 12 fits in a handheld or other transducer probe, such as in a transesophageal probe.

The multidimensional transducer array 12 is an array of piezoelectric or microelectromechanical (capacitive membrane) elements with or without the backing block 14. The elements are distributed along two dimensions. The array is flat, concave or convex. Full or sparse sampling is provided. The elements are distributed along any of various pitches, such as every 200, 208, 250, 400 or 500 micrometers, in a fully sampled spacing along two dimensions (e.g., N×M rectangular grid with N and M being integers greater than 1, such as 200×200). Each of the elements of the array includes at least two electrodes. The elements transduce between electrical and acoustical energies. The backing block 14 is positioned on one side of the array for limiting acoustic reflection from energy transmitted in an undesired direction. Matching layers, a lens, a window, or other now know or later developed multidimensional transducer array components may be included.

In another embodiment, the array 12 is one-dimensional. The modular assemblies 10 connect for operation with different elements along the lateral or azimuth dimension of the array 12.

For connection with the transmit and receive beamformer or other circuitry, a plurality of z-axis electrical connections are provided with the multidimensional transducer array 12. The z-axis electrical connections are distributed as an array. For example, a plurality of electrical conductors 16 connects one or more electrodes of each element through the backing block 14. The conductors 16 are part of the interconnect 18. The z-axis electrical connections are distributed in a same pitch and distribution as the elements of the array. The z-axis is more orthogonal than parallel with the surface of the distribution of the elements of the array (i.e., the z-axis corresponds to the depth or range dimension).

Figure 2:
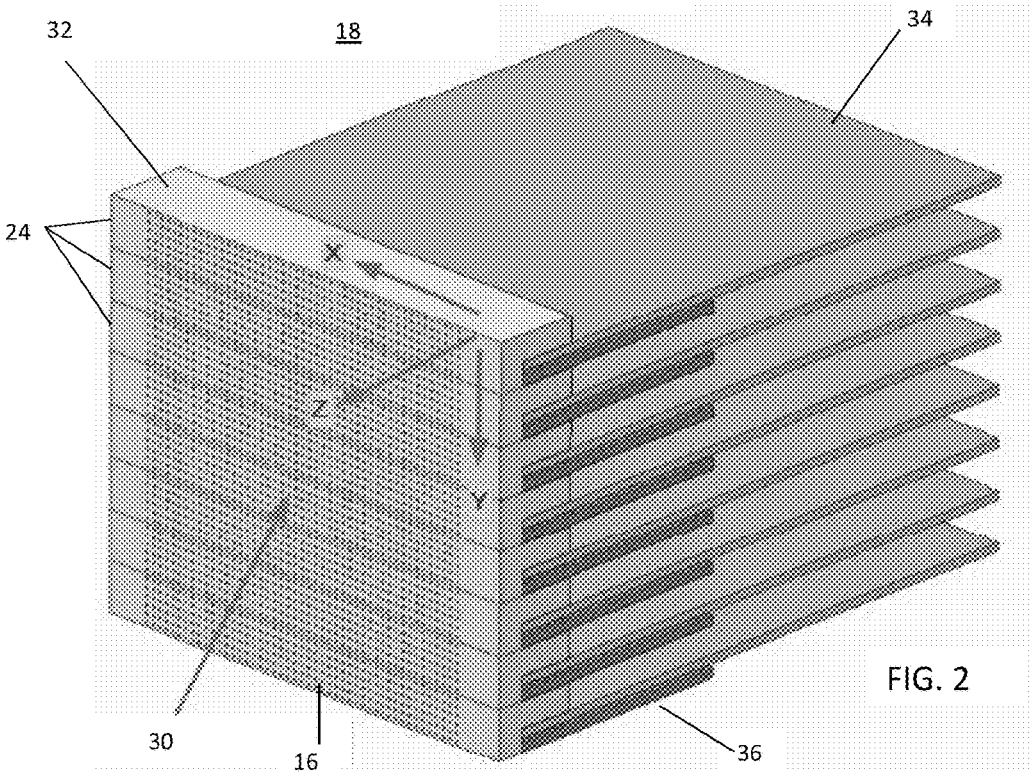
FIG. 2 is a perspective view of one embodiment of a stack of modules of an interconnect.

As shown in FIG. 2, modular assemblies or modules 24 are positioned adjacent to the multidimensional transducer array 12. While eight modules 24 are shown, other numbers may be used. The modules 24 form a surface 30 for resting against or electrically connecting with the array 12. The surface 30 with the exposed electrical conductors 16 is positioned adjacent to the multidimensional transducer array 12, such as adjacent to the exposed z-axis connections of a backing block 14 or to electrodes of the elements. Each of the modules 24 forms part of the surface 30, so connects with a subset of the elements. As shown, each subset includes entire azimuth rows (X dimension), but only portions of columns of elements in elevation (Y dimension). In alternative embodiments, a module 24 corresponds to a region with a lesser azimuth and/or elevation extent, a greater elevation extent, or a lesser azimuth extent. Other regions of the multidimensional transducer array 12 are adjacent to other modules 24.

The modular approach stacks the modules 24 to form the surface 30 for connection with the array 12. The surface 30 is flat, but may be curved. The surface 30 is the same as or larger along one or two dimensions than the extent of the array 12. On the surface, conductors 16 are exposed for physical and electrical contact with the electrodes of the elements of the array 12 or other z-axis connections from the array 12. The exposure pattern of the electrical conductors 16 is multidimensional. For example, the conductors 16 are distributed over two dimensions on the surface 30. The multidimensional exposure pattern or array of the electrical conductors 16 on the surface 30 corresponds to a multidimensional region of the elements of the array 12. The exposed electrical conductors 16 match the pitch or distribution to the elements of the multidimensional transducer array 12 along two dimensions (e.g., azimuth and elevation).

A single electrical conductor 16 per element of the array 12 is provided, but two conductors 16 per element of the array 12 may be provided. Singular contact is provided where a separate grounding plane is used with the transducer array. A biplex or two contacts per element may be used where transmit electronics are connected to one electrode of an element and receive electronics are connected to another electrode of a same element.

The exposed electrical conductors 16 allow for z-axis interconnection directly to the surface of the multidimensional transducer array 12, but may be indirectly connected in other embodiments. Once assembled adjacent to the multidimensional transducer array 12, the surface 30 and exposed electrical conductors 16 are in contact with the electrodes of the array 12 or other z-axis electrical connections of the transducer array 12. Bump connections, wire bonding or other connection techniques for connecting the exposed electrical conductors 16 to the electrodes may be used. The array 12 may be connected to the interconnect in any of various ways (e.g. stud bumping) to provide some dimensional compliance between the array and interconnect. The stud bumping connection may accommodate greater irregularity of the surface 30. Stud bumping deposits a wire-bond "stud" to one surface with the wire cut off. This leaves just a gold ball on the surface. When pressed together, these studs take up errors in parallelism. In an alternative, the surface 30 is made flat.

Figure 3:
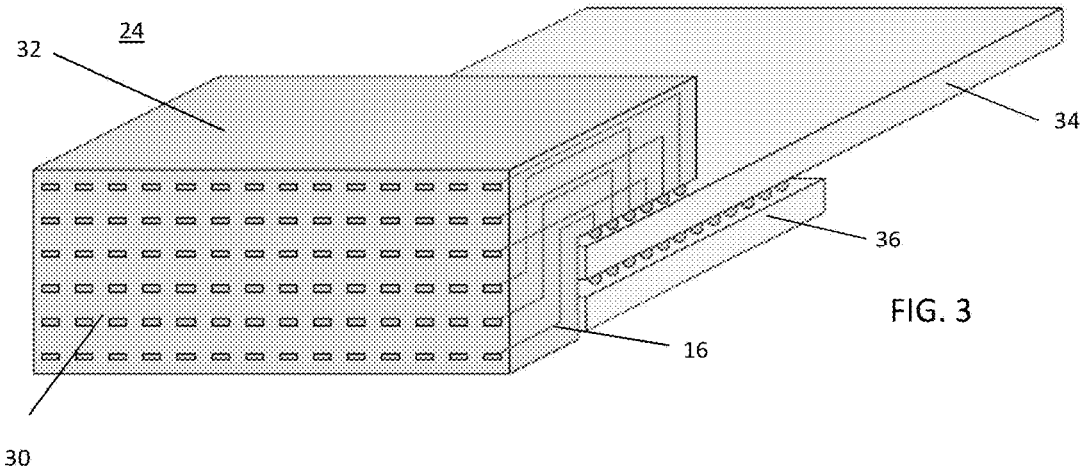
FIG. 3 is a perspective view of one embodiment of a module of an interconnect.

FIG. 3 shows an example of one embodiment of a module 24. The module 24 includes an adaptor 32, a printed circuit board 34, and an integrated circuit 36. Additional, different, or fewer components may be provided. For example, a thermal block or fins are added, such as adjacent to the integrated circuit 36 below the printed circuit board 34.

The adaptor 32 forms part of the surface 30 with the conductors 16 exposed on the surface 30 at a pitch of the elements of the array 12. The adaptor 32 connects with the array 12 once assembled.

Figure 4:
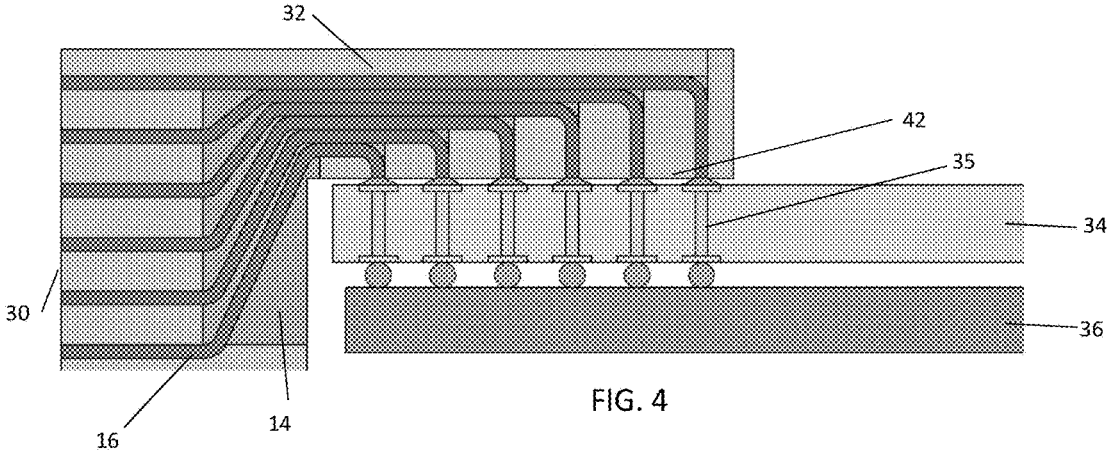
FIG. 4 is a cross-sectional view of the module of FIG. 3.

The adaptor 32 is ceramic, epoxy, other backing material, plastic, fiberglass, printed circuit board material, other material, or combinations thereof. The material of the adaptor 32 does or does not electrically insulate. Where the conductors 16 are insulated, the material of the adaptor 32 may not be insulating. Similarly, the material of the adaptor 32 may or may not be acoustically attenuating. In one embodiment, the adaptor 32 acts as a backing block. Part or the entire adaptor 32 is formed from backing material. FIG. 4 shows the backing material 14 as an interior part of the adaptor 32 with other material used for other portions. FIGS. 1A and B show the backing 14 formed on the surface 30, such as by dicing the surface around the conductors 16 and filling the resulting channels with acoustic backing. In other embodiments, a separate backing is provided, and the adaptor 32 does not include backing material.

The adaptor 32 includes the conductors 16. The ends of the conductors 16 are to electrically connect with the electrodes of the elements of the array 16 and pads or vias of the printed circuit board 34. The conductors 16 are traces, such as traces formed by depositing and/or etching. Alternatively, the conductors 16 are wires. The wires are insulated or not insulated. In one embodiment, the wires are magnet wire, so are self-insulated. The wires may contact each other without electrically connecting. The wires may include other materials, such as being coated with a thermal bonding agent. When heated, the wire bonds to a substrate on which the wire is resting.

Referring to FIGS. 3 and 4, the adaptor 32 includes multiple surfaces, such as the array contact surface 30 and a mounting surface 42. The mounting surface 42 is shaped and sized for mounting with the printed circuit board 34, such as for an edge mount. For example, the mounting surface 42 is flat with an extent allowing for the conductors 16 to connect with the printed circuit board 34. In one embodiment, the adaptor 32 is solder-mounted to the printed circuit board 34. In another embodiment, the adaptor 32 is bonded to the printed circuit board 34 with conductive adhesive. The extent may be over an entire width (e.g., azimuth) of the array 12 or more with depth for the conductors 16 to be distributed or exposed on the mounting surface 42 at a pitch of pads and/or vias of the printed circuit board 34 or of pads of the integrated circuit 34. Stepped surface, non-flat surface and/or other extents may be used.

The pitch of the conductors 16 on the array contact surface 30 is different than the pitch of the conductors 16 on the mounting surface 42. The difference is along one or two dimensions. In one embodiment, the conductors 16 are routed within the adaptor 32 so that the pitch transitions from the array pitch to the integrated circuit pitch in two dimensions. For example, the element pitch is on a regular grid of 0.2 mm or 0.208 mm in azimuth and elevation. The conductors 16 change pitch from the 0.2 mm or 0.208 mm to 0.25 mm in both dimensions. Rather than transitioning from a smaller array pitch to a larger printed circuit board pitch, the conductors 16 may change from a larger array pitch to a smaller circuit board pitch. In another embodiment, the pitch changes in one dimension and the route of traces and/or vias in the printed circuit board changes the pitch in the other dimension.

The two surfaces 30, 42 on which the conductors 16 are exposed are not parallel. Rather than providing z-axis interconnection with the conductors 16 perpendicular to the array 12 between the array 12 and connection to the next component, the conductors 16 are angled, bent, or both. The two surfaces 30, 42 are at a non-zero angle relative to each other. FIG. 4 shows the angle as about 90 degrees. About is used to account for manufacturing tolerances. Other angles may be provided, such as 30, 45, 60, or 80 degrees.

Other surfaces are provided and arranged to allow stacking of the modules 24. For example, parallel surfaces perpendicular to the surface 30 are flat and allow for stacking. In one embodiment, the adaptor 32 is formed as two cuboids that, when combined, have an "L" shape in cross-section as shown in FIGS. 3 and 4. The adaptor 16 may have this shape but be of unitary construction. The "L" shaped cross-section allows for the printed circuit board 34 and integrated circuit 36 to fit behind the surface 30 while allowing stacking of the modules 24 to connect with all the elements of the array 12. Other shapes may be used, such as a "U" shape with the surface 30 being at the bottom of the "U" and the mounting surface 42 being one or both of the interior parts of the upper "U" arms. Some components on a given module need not lie directly in that modules element shadow as long as these features "nest" with adjacent modules.

The mounting surface 42 is shaped and sized to surface mount to the printed circuit board 34. For example, flow soldering is used to mount the adaptor 32 to the printed circuit board 34. FIG. 4 shows an example of such mounting. Other mounting may be used, such as solderball-based mounting as shown in FIG. 3. Additional structural connection may be provided, such as one or more screws, guideposts, bolts, clips, or other structure.

FIGS. 5-12 show different approaches for creating the adaptor 32. The adaptor 32 is created to easily mount (e.g., surface mount) to the printed circuit board 34 using a standard printed circuit board process while also exposing the conductors 16 on one surface 30 for the array 12 and on another surface 42 for the printed circuit board 34. Other approaches may be used.

Figure 5:
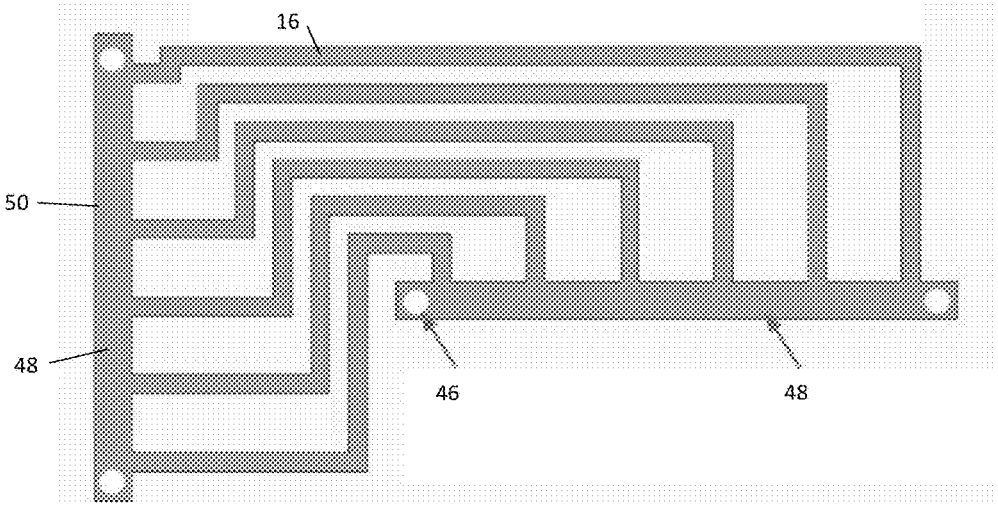
FIG. 5 is a side view of one embodiment of conductors for an adaptor.
Figure 6:
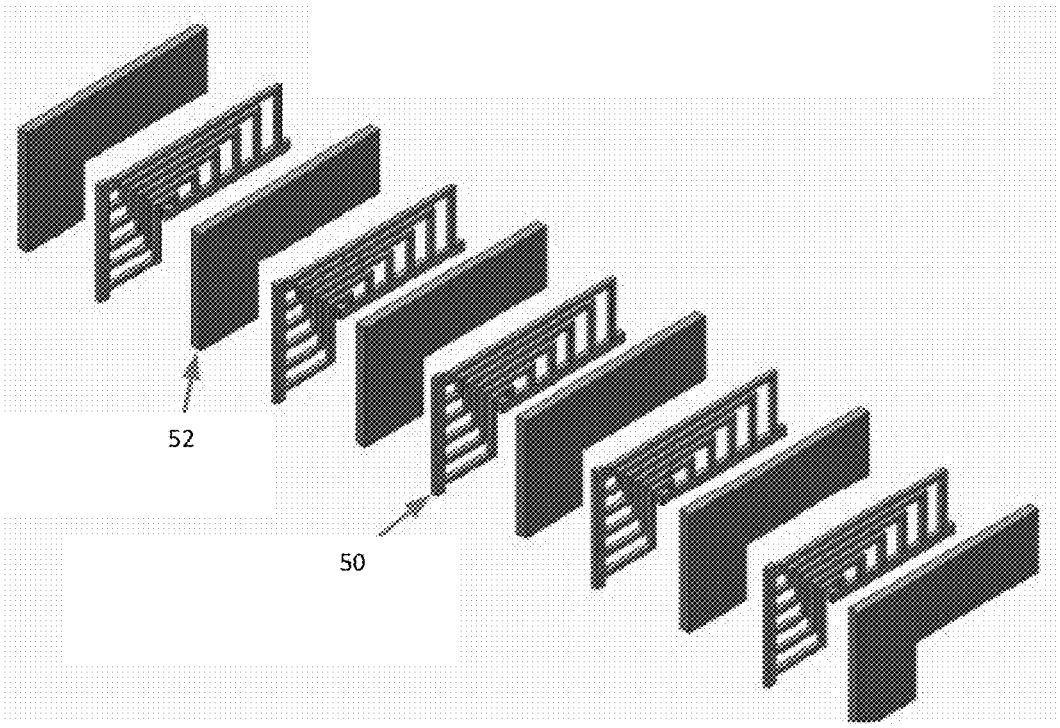
FIG. 6 is an exploded view of conductors and insulators for one embodiment of an adaptor.

FIGS. 5 and 6 shows one approach using a multiple conductor plate or pattern 50 and electrical insulator substrate 52. Stamping, etching, or depositing forms the conductors 16. The pattern 50 of the conductors 16 is formed as a separate piece or is formed on a substrate 52. The substrate 52 is electrically insulating.

The pattern 50 includes end connectors 48 to hold the pattern 50 of the conductors 16 together. The end connectors 48 may include one or more guide or interstitial holes 46 for assembly or stacking.

As shown in FIG. 6, layers of the pattern 50 and substrate 52 are stacked and laminated to form the adaptor 32. The prefabricated plates or patterns 50 are alternately laminated with insulator substrate 52 to build up the structure in the azimuth direction. Glue or other adhesive is used to laminate. Once laminated, the guide holes 46 may be filled or not. To complete the adaptor 32, the end connectors 48 are machined (e.g., sanded, grinded, or cut) off to separate the conductors 16.

The pattern 50 may provide for a change in pitch along one direction or dimension. The stacking process results in the adaptor 16 providing pitch change in one dimension, not two dimensions. In alternative embodiments, two dimensional pitch change is provided. The pattern 50 is formed on the substrate 52. The substrate 52 and pattern 50 are thin enough to be flexible. A guide is provided to curve or bend the substrates along a Y dimension. Different curvature or amounts of variation may be provided for the different substrates 52. As a result, the pattern provides pitch change in the X dimension and the bend in the substrates provides the pitch change in the Y dimension. Once stacked in the guide, gaps are filled with epoxy or other material (e.g., acoustic backing material).

Figure 7:
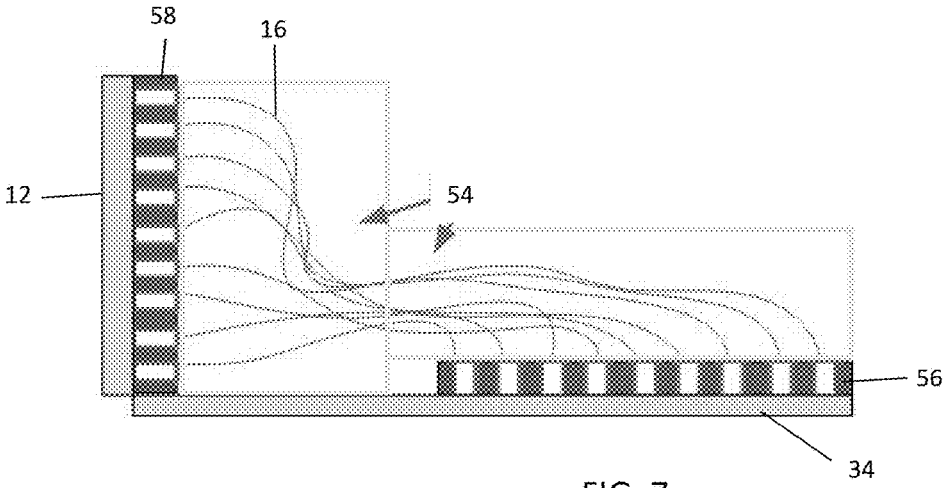
FIG. 7 is a cross-sectional view of one embodiment of an adaptor using bent wires.
Figure 8:
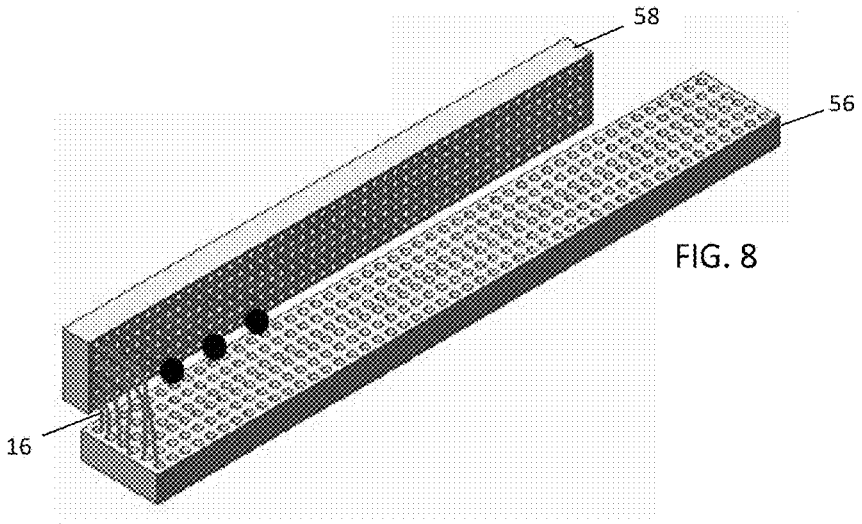
FIG. 8 is a perspective view showing two plates used in the adaptor of FIG. 7.

FIGS. 7 and 8 show a different approach for forming the adaptor 32. Pitch change is provided in one or two dimensions by insulated wires as the conductors 16. For example, magnet wires are used to minimize space needed for insulation. Two plates 58 and 56 are provided. One plate 58 has holes distributed at the pitch of the array 12, and the other plate 56 has holes distributed at the pitch of the printed circuit board 34.

To assemble, the plates 56, 58 are held parallel from each other. The conductors 16 are inserted one at a time or in groups through the holes in the plates 56, 58. For example, a conductor 16 is inserted through both plates 56, 58 with the plates 56, 58 arranged to align the holes for a given conductor 16. One plate is then shifted relative to the other to align the holes despite the difference in pitch. The alignment and insertion process is repeated in rows and columns. Once the conductors 16 are inserted, the plates are positioned as desired for the adaptor 32, such as rotating the plate 56 by 90 degrees and moving relative to the other plate 58. As positioned, the plates 56, 58 and conductors 16 are positioned in an injection mold die. Epoxy or other backfill material 54 is added to hold the conductors 16 and plates 56, 58 in place. After releasing the die, the adaptor 32 may be ground or machined to size.

Once assembled, the plates 56, 58 are positioned relative to each other to form the adaptor 32. FIG. 7 shows the plates 56, 58 arranged at 90 degrees relative to each other, but with the printed circuit board 34 extending beyond the extent of the surface 30. While this may be acceptable at an end of the stack of modules 24, the arrangement for other modules 24 is as shown in FIG. 4.

Figure 9:
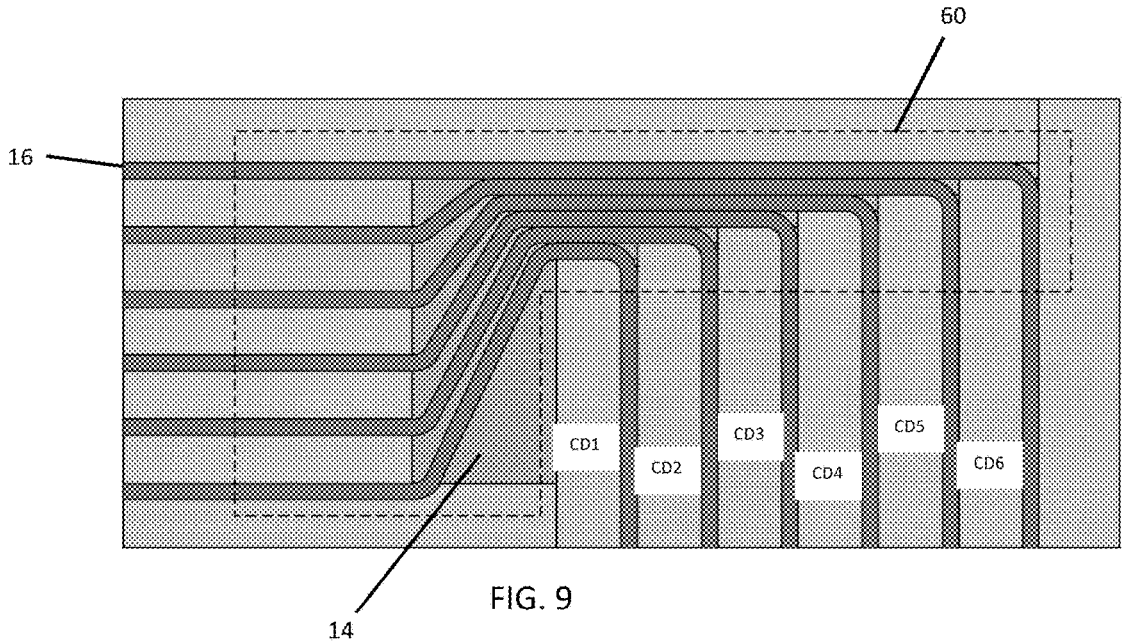
FIG. 9 is a cross-sectional view of another embodiment of the adaptor using plate construction.
Figure 10A:
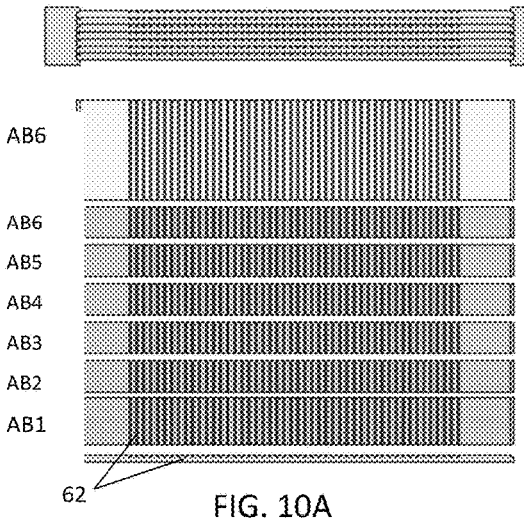
FIGS. 10A and B show assembly of the adaptor of FIG. 9.
Figure 10B:
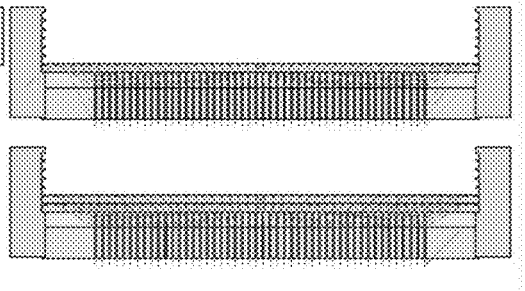

FIGS. 9, 10A, and 10B show yet another approach for forming the adaptor 32. The adaptor 32 is built up by stacking plates. In FIGS. 9 and 10A, the plates for forming the array contact surface 30 are labeled AB1-AB6. Additional or fewer plates may be used. The plates for forming the mounting surface 42 are labeled as CD1-6 in FIG. 9. No, one, or more additional cover or end plates may also be used, such as a top cover plate and a back cover plate.

Each plate is formed from plastic, but may be ceramic, acoustic backing (e.g., cured epoxy), or other material. Electro-forming, etching, molding, 3D printing, or other process forms the plates AB1-6 and CD1-6.

The plates for a given surface are of the same size, but some may be larger or smaller, such as AB1 being deeper than AB2-6 or each of CD1-6 having a different depth (vertical as shown in FIG. 9). The height or thickness (vertical in FIG. 9 for plates AB1-6 and horizontal in FIG. 9 for plates CD1-6) is based on the desired pitch in one dimension. For example, each plate AB1-6 for forming the surface 30 has a height at the pitch of the elements along one dimension. The thickness for the other plates CD1-6 is different than for AB1-6 to effect a pitch change.

The plates AB1-6 and CD1-6 include grooves or channels 62. Dicing or molding forms any number of channels 62. The channels 62 are distributed at the pitch along another dimension. The channels 62 in the plates AB1-6 are at a different pitch than the channels 62 in the plates CD1-6.

FIG. 10B shows the plates AB1-6 oriented at 90 degrees (perpendicular) relative to the plates CD1-6 with the channels at different pitches. With the heights different as well, the plates AB1-6 as stacked (see top of FIG. 10A) create the surface 30 with exposed channels 62 in the array pitch, and the plates CD1-6 as stacked create the surface 42 with exposed channels 62 in the different pitch (e.g., integrated circuit pitch). The channels 62 are at different spatial density in the plates AB1-6 than for the plates CD1-6.

To create the adaptor 32, plates AB1 and CD1 are held in position relative to each other. A wire end is attached, such as attached to a bottom of plate AB1. The plates AB1 and CD1 are rotated. A coil of wire, such as magnet wire, deposits a single strand in a continuous manner in each channel. The rotation may be in increments, such as rotating 90 degrees to bring the wire to bear on a corner of plate CD1. By rotating another 90 degrees, the wire begins to be placed into the CD1 channel. A finger or armature presses the wire down into the AB1 channel in this position, but leaves an angled region of the wire in the region for backing 14 for pitch transition. A further rotation of 90 degrees places the wire into the rest of the CD1 channel. A final rotation of 90 degrees positions the wire on a bottom of the plate AB1 for positioning in a next channel. The rotation process is repeated to fill all of the channels of the plates AB1 and CD1.

After winding, each channel has a single instance of the wire with the wire extending between the plates AB1 and CD1 at an angle based on the difference in pitch, as shown in FIG. 10B. Additional plates AB2 and CD2 are added (e.g., stacked) and the wire wound in the channels of those plates AB2 and CD2. The process is repeated for each layer of plates. After placing any covers, any remaining gaps are filled, such as with acoustic backing 14. The fill or other adhesive is used to laminate the plates AB1-6 together, the plates CD1-6 together, the covers to the stacks, and/or the stacks of plates AB1-6, CD1-6 to each other. The resulting structure is shown in FIG. 9. This structure is the adaptor 32. Alternatively, the structure is machined (e.g., cut, sanded, etched, or otherwise removed) to the dotted lines 60. This machining removes excess material, leaving the adaptor 32.

Figure 11:
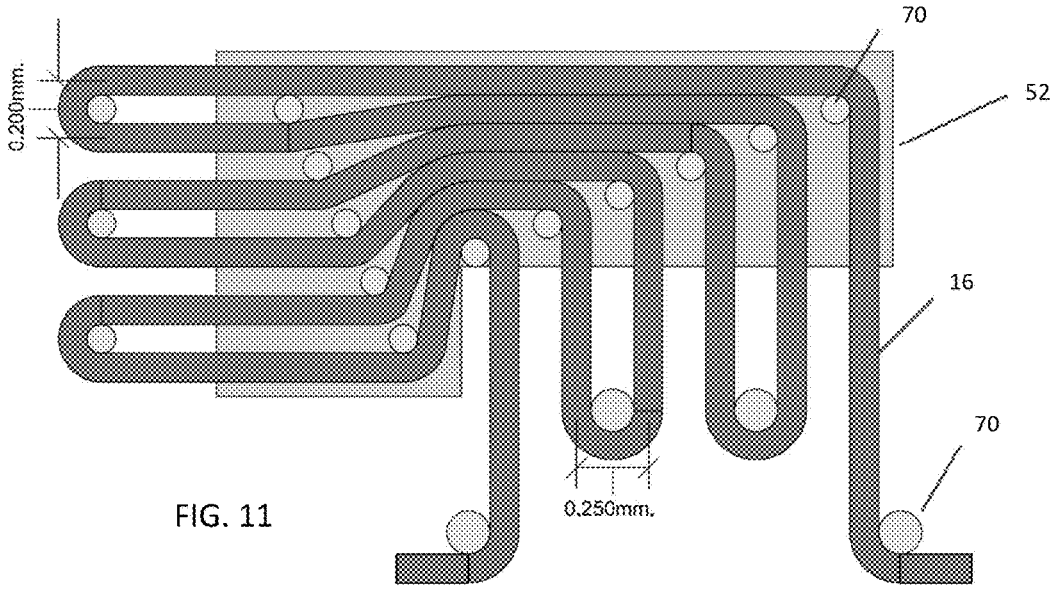
FIG. 11 is a cross-sectional view of yet another embodiment of the adaptor using wire wrapping.

FIG. 11 shows yet another approach for forming the adaptor 32. A substrate 52 has holes for pins 70. A wire forming the conductors 16 is wrapped around the pins 70. The wire includes thermo-setting adhesive. Alternatively, the substrate 52 includes adhesive. The wire is electrically insulated, such as magnet wire, allowing physical contact of the conductors 16 while preventing electrical contact. After wrapping of the wire, the wire bonds to the substrate 52. A plurality of such substrates 52 with conductors 16 is stacked after removing the pins or with the pins remaining. Parts of the resulting stack are removed by machining, separating the wire for each layer into the plurality of separate conductors 16. The resulting adaptor 32 provides a pitch change in one dimension based on the positions of the pins 70. The substrate 52 is flat. For altering pitch in another dimension, the substrates 52 are placed in a guide to curve or angle the substrates 52 relative to each other.

Figure 12:
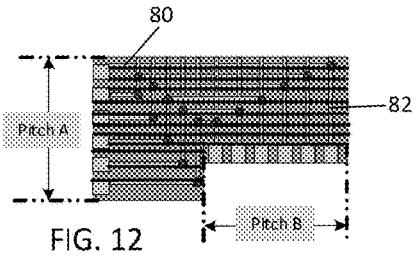
FIG. 12 is a cross-sectional view of another embodiment of the adaptor using a ceramic printed circuit board.

FIG. 12 shows another approach for forming the adaptor 32. The adaptor 32 is constructed as a ceramic printed circuit board. The conductors 16 are formed from traces 80 (e.g., silver or tungsten traces) and vias 82 (punched holes filled with a metal paste). The traces 80 connect with vias 82 to form the conductors 16. The ceramic or other material is built up using multi-layer processing. The horizontal dashed lines depict the internal layered structure used to build up the adaptor 32. By routing in the ceramic layers, the conductors 16 provide the desired pitch adjustment and 90 degrees relative position of the surfaces 30, 42. The conductors 16 on the surfaces 30, 42 are terminated with contact pads or metalized contact areas. The traces 80 and vias 82 are patterned to provide the one or two-dimensional pitch change.

In yet another approach, flexible circuit material is used. Flexible circuit with traces on one or two sides connects to one or two rows of elements. The traces are routed to change pitch. By stacking the flexible circuits, the various rows of the elements connect to traces. The flexible nature of the material is used to alter pitch in another dimension. A spacer may be connected to one end (e.g., to form the surface 42 for connection to the printed circuit board 34) or to each end of each of the flexible circuit material layers. The spacers are then stacked and bonded to hold the layers of flexible circuit material in position. To form the surface 30 for the array, the spacers are made of backing material and/or the flexible circuit material in inserted into diced slots in a backing block. The adaptor is then potted or filled with backing material and cured. The surfaces 30, 42 are formed by grinding excess material. A mask to only show flex traces is applied and then electrodes are sputtered.

Returning to FIGS. 3 and 4, the printed circuit board 34 is formed from FR4, Teflon, ceramic, or sequential buildup of materials using pressing, laminating, sintering, or other techniques. Any now known or later developed circuit board material or other electrically insulative materials may be used. The printed circuit board 34 is a flat plate, such as a board having top and bottom largest surfaces connected by short sides. A cuboid is formed. Other more complex shapes may be provided. The printed circuit board 34 may also be a "rigid flex" board with rigid layers and flex layers mixed. In one embodiment, a 4-layer board with two rigid outer layers and two flex inner layers is used. All components mount to the rigid layers. The flex layers emerge from the opposite side from the array 12 as a "tail". This allows commercially available connectors to be used that are physically larger than the individual module cross section. Most transducers have a handle that tapers at the array end but is larger elsewhere.

The printed circuit board 34 includes traces, vias 35, pads, or other conductive structures. Additional passive and/or active electronics may be connected to the printed circuit board 34 on either of the top or bottom surfaces. For example, capacitors mount to the top surface (e.g., same surface as the adaptor 32) and/or the bottom surface (e.g., same surface as the integrated circuit 36). The adaptor 32 surface mounts to one part of the top or bottom surface, such as edge mounting near an end as shown in FIG. 4. The planar surface 42 of the adaptor 32 mounts or mates with the surface of the printed circuit board 34. Surface mounting at other locations along the edge of the printed circuit board 34 may be used.

The traces and/or vias 35 electrically connect the conductors 16 of the adaptor 32 to the integrated circuit 36. In one embodiment, the conductors 16 in the adaptor 32 change the pitch from the array pitch to the pitch of the integrated circuit 36. Pads or conductors of the integrated circuit 36 are at a different pitch in one or two dimensions than the pitch of the array 12. Where the conductors 16 on the mounting surface 42 match the pitch of the integrated circuit 36, conductive vias 35 at the same pitch as the integrated circuit 36 and the conductors 16 on the mounting surface 42 electrically connect the conductors 16 with the integrated circuit 36, as shown in FIG. 4.

The conductors 16 are positioned to route signals to and from the multidimensional transducer array 12 to the printed circuit board 34. The printed circuit board 34 is configured to route signals from the conductors 16 to the integrated circuit 36. These interconnections electrically connect the electrodes of the elements of the array 12 to the active electronics of the integrated circuit 36 without any flexible circuit. No flexible circuit carries the signals between the multidimensional transducer array 12 and the integrated circuit 36. In alternative embodiments, flexible circuit or other routing is provided as an intervening component. In the case of a 4-layer rigid-flex printed circuit board 34, the flex circuit only acts as a through-layer as part of the via structure when connecting the array to the integrated circuit 36. No traces on the flex circuit are required for this purpose. The flex inner layer makes connections from the interconnect to the system.

In other embodiments, the pitch of the conductors 16 on the mounting surface 42 is different than the pitch of the pads for the integrated circuit 36. For example, the adaptor 32 provides a pitch change in just one dimension and/or only part of the pitch change in one or both dimensions. The printed circuit board 34 uses traces and/or vias to implement further pitch change to mate with the integrated circuit. The pitch on the top surface matches the pitch of the conductors 16 of the mounting surface 42 of the adaptor 32, and the pitch on the bottom surface matches the pitch of the pads of the integrated circuit 36. Vias and/or traces on or in the printed circuit board 34 are used to alter between the two pitches.

In one embodiment, the integrated circuit 36 connects to the printed circuit board 34 at a location offset along the largest opposing surfaces of the printed circuit board 34 from the mounting surface 42. This offset allows the use of traces to alter the pitch. In other embodiments, the integrated circuit 36 connects in a same lateral zone as the mounting surface 42 of the adaptor 32 as shown in FIG. 4. More or less overlap may be provided. Additional layers of printed circuit board 34 may be used for routing traces and vias to implement the pitch change in the more limited lateral space due to the overlap. This may minimize the length of the traces and vias along each conductive path from the array 12 to the integrated circuit 36, resulting in less crosstalk and/or less parasitic capacitance.

The integrated circuit 36 is a chip or semiconductor with one or more active electrical components, such as transistors. "Active" electrical component is used to convey a type of device rather than operation of the device. Transistor-based or switch-based devices are active while resistors, capacitors, or inductors are passive devices. In one embodiment, the integrated circuit 36 is an application specific integrated circuit. Field programmable gate arrays, memory, processor, digital circuits, switches, multiplexers, controllers, or other integrated circuits may be provided. One integrated circuit is provided for each module 24, but more than one integrated circuit 36 may connect on the same or different sides of the printed circuit board 34.

The integrated circuit 36 is configured by instructions (e.g., software), hardware, or firmware to perform transmit and/or receive operations in ultrasound. For example, the integrated circuit 36 includes high voltage components of a transmit beamformer for generating transmit waveforms, transmit/receive switching, low noise amplifying, and/or partial receive beamforming. Other ultrasound processes may be implemented.

The integrated circuit 36 connects with the printed circuit board 34 with solderballs, flow soldering, or other surface mount technique. Some of the pads of the integrated circuit 36 connect with the conductors of the printed circuit board 34 for communication with the elements of the array 12, such as through the vias 35 as shown in FIG. 4. Other pads of the integrated circuit 36 connect with the conductors of the printed circuit board 34 (as shown in FIG. 3) for use of other mounted components (e.g., capacitors) on the printed circuit board 34 and/or for communication to a flexible circuit or other connector mounted to the printed circuit board 34 for mating with the connector 20.

In the example of FIG. 4, the integrated circuit 36 mounts to a side (e.g., bottom surface) opposite the mounting surface 42 of the adaptor 32. Opposite side connection may minimize interconnect length. Alternatively, the adaptor 32 and integrated circuit 36 mount on a same side of the printed circuit board 34 but at different lateral locations. The integrated circuit 36 may be mounted to the same surface as the adaptor 32 with printed circuit board traces interconnecting them instead of on the opposite side.

In the module 24, the printed circuit board 34 and the integrated circuit 36 are entirely within a volume defined by a spatial extent of the surface 30 for mating with the array 12 and any depth z as shown in FIG. 2. While the printed circuit board 34 and/or integrated circuit may extend further along the azimuth or X dimension, the extent along the Y dimension is limited to allow stacking of the modules 24 for mating with the array 12. As stacked, the pitch of the conductors 16 on the surface 30 matches the pitch of the elements of the array 12. The printed circuit board 34 and integrated circuit 36 are positioned relative to the adaptor 32 to allow the stacking.

Figure 13:
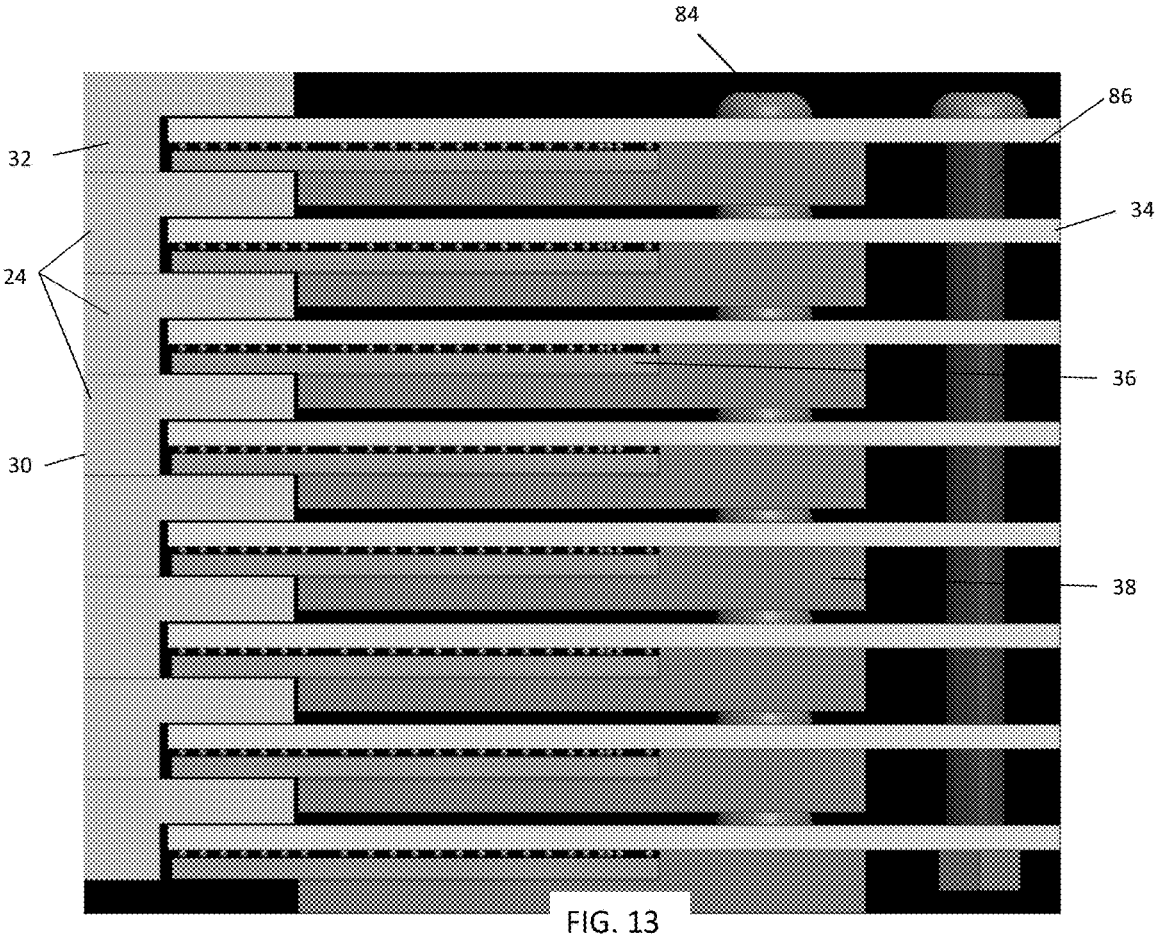
FIG. 13 is a cross-sectional view of an embodiment of a stack of modules of an interconnect.

Referring to FIG. 13, each module 24 may also include a thermal conductor block 38. The thermal conductor block 38 is a metal fin or other heat conducting and/or radiating structure. The thermal conductor block 38 is positioned against or in close proximity to the integrated circuit 36, allowing cooling of the integrated circuit 36. Further thermal conduction components may be provided, such as circulated fluid (e.g., gas, air, or liquid) passing by or through the thermal conductor block 38. A heat sink may be provided for passive and/or active cooling. The thermal conductor block 38 does not prevent connections of the interconnect 18 with the imaging system since the connector on the printed circuit board 34 for mating with the connector 20 may be mounted on a top surface or opposite surface of the printed circuit board than the integrated circuit.

Additional or different heat removal devices may be provided. For example, the grounding plane or planes of the printed circuit board 34 are used to conduct heat away from the integrated circuit. As another example, one or more heat pipes are used. Heat pipes may be used within or attaching to the thermal conductor block 38 to assist in removing heat from the interconnect assembly.

Once assembled, the modules 24 are stacked. Any number of modules 24 may be stacked, such as six modules or eight modules. The modules 24 are stacked such that the adaptors 32 are in contact with each other, providing the surface 30 for mating with the array 12. Enough modules 24 are stacked so that conductors 16 are provided for electrical connection with all of the elements of the array 12.

Once stacked or as part of stacking, the modules 24 are laminated. Adhesive between the adaptors 32 is cured to bond the modules 24 together. Clamping, bolting, wrapping, or other connection may be used. As shown in FIG. 13, spacers 84 are provided to hold the portion of the module 24 spaced from the adaptor 32 in position. A pin 86 and a bolt and nut, with or without spacers along the pin, may be used instead or with the spacers 84. Other support structure may be used.

Once assembled, the interconnect 18 may be machined. For example, grinding excess material forms the surface 30. This may allow for greater tolerance in stacking and laminating the modules 24 since the grinding flattens the surface 30.

The resulting interconnect 18 includes the surface 30 with exposed electrical conductors 16 corresponding to a pattern of the elements of the array 12. The electrical conductors 16 are connected with of the elements of the array 12. Bump bonding, asperity contact, wire bonding, flow soldering, or other now known or later developed technique connects the array 12.

Bonding, laminating, mechanical connection (e.g., bolt, screw or latch) or pressure may be used to position and maintain the modules 24 relative to each other and/or the interconnect 18 relative to the array 12. Tongue and groove, extensions and holes or other structures may be used to assist in alignment or positioning.

Referring to FIG. 1A, the interconnect 18 connects with the ultrasound imaging system or scanner with further electronics for beamforming, beamformer control, detection, estimation, image processing, and/or scan conversion. Each of the modules 24 electrically connects to the imaging system. The connection uses standard or off-the-self connectors mounted to the printed circuit boards 34, such as edge connectors to a common interface board connector. The connectors 20 mate physically and electrically with the connectors on the printed circuit board. Alternatively, the flexible circuit 22 is connected to traces or pads on the printed circuit boards 34 using anisotropic conductive film or other connectors.

Figure 14:
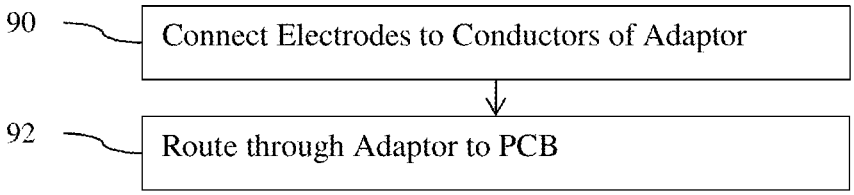
FIG. 14 is a flow chart diagram of one embodiment of a method for interconnecting active electronics with a multidimensional transducer array.

FIG. 14 shows one embodiment of a method for routing signals in an ultrasound transducer. Manufacturing of a matrix transducer is reduced to a small number of high yield production acts by using standard printed circuit board and surface mounted components. The printed circuit board technology is off-the-shelf. The adaptor may be manufactured in one of various ways and mounted to the printed circuit board in a standard way.

The method is implemented using one of the adaptors discussed above or a different adaptor. The method may be implemented using one or more modules and/or interconnect discussed above or different modules and/or interconnect.

Additional, different, or fewer acts may be provided. For example, acts for routing signals from the printed circuit board to the integrated circuit are provided. As another example, other assembly acts to create the module and/or interconnector from the modules are provided. The acts are performed in the order shown or a different order.

In act 90, electrodes of elements are connected to conductors along a z-axis of an array of the elements. The electrodes and conductors at the electrodes are distributed at a same pitch for the connection. To create the conductors at the desired pitch, the adaptor is provided. The adaptor is part of a module also including a printed circuit board and integrated circuit, such as described above. A stack of modules laminated to form an interconnect provides the conductors at the desired pitch for the array.

The conductors from the adaptor are connected with a subregion of the multidimensional transducer array. For example, the multidimensional transducer array is divided into two or more regions. Two or more different modules with exposed conductors are connected with the two or more different regions. The regions may be of any shape or size or other distribution. The exposed conductors are placed adjacent to the electrodes of the multidimensional array, such as positioning for z-axis connection. Each region (e.g., module) of exposed conductors corresponds to a subset of elements of the multidimensional transducer array.

Through asperity contact, wire bonding, solder, flow soldering, bonding, or other electrical connection technique, an electrical connection between the transducer array and exposed conductors is provided. Mechanical connection may also be provided, such as by bonding, mechanical devices (e.g., latch or bolt), or combinations thereof.

Other connects may be made. For example, the adaptor is surface mounted to a printed circuit board. Edge mounting is used, such as with solderballs, asperity contact, or flow soldering or stud bumps with conductive or insulating adhesive. The printed circuit board includes other mounted components or the other components are mounted at a same time or after the adaptor. One of the other components mounted with solderballs, flow soldering, or other technique is one or more chips with active electronics, such as transistors for performing transmit and/or receive operation of the array.

In act 92, conductors are routed from the elements of the array to a surface spaced from the electrodes of the elements. The conductors connect to the elements on one end in the adaptor and connect to a different surface on the other end for interconnecting between the array and electronics. The surface is other than parallel with the array. The routed conductors also change pitch along one or two dimensions from the array to the surface mounted to the printed circuit board.

The printed circuit board interconnects the conductors from the adaptor to the electronics. Signals to and from the array are routed through the printed circuit board and adaptor.

While the invention has been described above by reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

We claim:

1. A multidimensional transducer array system, the system comprising:

first and second modules, each of the first and second modules comprising:

an adaptor having first and second planar surfaces oriented about 90 degrees relative to each other, the first planar surface connected with the multidimensional transducer array;

conductors in the adaptor, separate ones of the conductors electrically connected with separate elements of the multidimensional transducer array;

a printed circuit board having a top surface connected with the second planar surface of the adaptor, the conductors electrically connected with the printed circuit board; and an integrated circuit connected with the printed circuit board such that signals on the conductors are provided at the integrated circuit;

the first module stacked with the second module such that the adaptors are in contact with each other and the adaptors are in contact with different parts of the multidimensional transducer array.

2. The system of claim 1 wherein the conductors on the first planar surface have a first pitch and the conductors on the second planar surface have a second pitch different than the first pitch.

3. The system of claim 2 wherein the second pitch is different along two dimensions than the first pitch.

4. The system of claim 1 wherein the adaptor surface mounts with flow soldering or stud bumping with conductive adhesive to the printed circuit board and wherein the integrated circuit surface mounts to an opposite surface of the printed circuit board than the adaptor, the printed circuit board comprising a flat plate.

5. The system of claim 1 wherein the conductors comprise wires.

6. The system of claim 5 wherein the adaptor comprises first and second sets of plates with grooves, the first set and second set of plates perpendicular to the first and second planar surfaces, respectively, the wires extending through the grooves.

7. The system of claim 1 wherein the conductors comprise magnet wire and the adaptor comprises acoustic backing material.

8. The system of claim 1 wherein the conductors route in the adaptor from the first planar surface to the second planar surface.

9. The system of claim 1 wherein the adaptor comprises a plurality of stacked curved surfaces and the conductors comprises wires on the curved surfaces.

10. The system of claim 1 wherein the printed circuit board comprises a cuboid shape having vias at a pitch for the integrated circuit, the conductors on the second planar surface having the array pitch.

11. The system of claim 1 wherein the integrated circuit comprises an application specific integrated circuit connected to the printed circuit board.

12. The system of claim 1 wherein each of the first and second modules further comprises a thermal conductor block thermally connected with the integrated circuit.

13. The system of claim 1 further comprising at least third and fourth modules, the first, second, third, and fourth modules connecting respective ones of the conductors all of the elements of the multidimensional transducer array.

14. The system of claim 1 wherein the conductors are positioned to route signals from the multidimensional transducer array to the printed circuit board, the printed circuit board is configured to route signals from the conductors to the integrated circuit, where no flexible circuit outside the printed circuit board carries the signals between the multidimensional transducer array and the integrated circuit.

* * * * *